US007100352B2

(12) United States Patent
Robins

(10) Patent No.: US 7,100,352 B2
(45) Date of Patent: Sep. 5, 2006

(54) PROTECTIVE COMPOSITE YARN

(76) Inventor: Steven D. Robins, 3612 Sunrise Dr. West, Minnetonka, MN (US) 55345

( * ) Notice: Subject to any disclaimer, the term of this patent is extended or adjusted under 35 U.S.C. 154(b) by 339 days.

(21) Appl. No.: 10/761,470

(22) Filed: Jan. 21, 2004

(65) Prior Publication Data

US 2005/0155336 A1 Jul. 21, 2005

(51) Int. Cl.
*D02G 3/02* (2006.01)

(52) U.S. Cl. ..... 57/210
(58) Field of Classification Search ..... 57/210, 57/211, 230
See application file for complete search history.

(56) References Cited

U.S. PATENT DOCUMENTS 5,423,168 A * 6/1995 Kolmes et al. ..... 57/229
5,547,733 A 8/1996 Rock et al.
6,155,084 A 12/2000 Andrews et al.
2002/0035755 A1 3/2002 Widdemer
2002/0124324 A1 9/2002 Widdemer

FOREIGN PATENT DOCUMENTS

WO WO 03/083189 10/2003

OTHER PUBLICATIONS www.holofiber.com. Sports Edge Magazine, Aug. 2003.*

* cited by examiner

*Primary Examiner*—Shaun R. Hurley
(74) *Attorney, Agent, or Firm*—Schwartz Law Firm P.C.

(57) ABSTRACT

A composite protective yarn is incorporated into an article of apparel. The protective yarn has a core unit including a protective material selected from a group consisting of metallic filament, glass, and high tenacity fiber having a tensile strength of at least 7 grams per denier. A cover is applied to the core unit and is adapted for residing adjacent the skin. The cover includes an optically responsive material adapted for absorbing infrared radiation emitted from the human body at a first wavelength and returning the absorbed radiation to the body at a second longer wavelength. This relaxes capillaries and promotes increased blood flow to body parts covered by the article of apparel.

23 Claims, 3 Drawing Sheets

PROTECTIVE COMPOSITE YARN

TECHNICAL FIELD AND BACKGROUND OF THE INVENTION

This invention relates to a protective, body-reactive composite yarn and protective apparel incorporating the composite yarn. The yarn is particularly adapted for use in, for example, gloves, aprons and arm and leg covers used by employees in meat processing or packing plants, or in industrial metal fabrication plants. In particular, the gloves permit plant employees to more safely and efficiently perform their duties while avoiding injury due to accidental cuts from sharp knives or metal edges.

Prior art yarns use specific combinations of materials in attempting to achieve a cut resistant yarn core. The core is typically wrapped with protective and abrasion resistant cover yarns to facilitate knitting, and to give the yarn an acceptable hand. Such yarns have previously been incorporated in protective gloves. For example, U.S. Pat. No. 4,384,449 issued to Byrnes et al., discloses a protective glove formed of a yarn having a core of flexible wire alongside an aramid fiber strand, and wrapped with aramid fiber strand going in opposite directions.

U.S. Pat. No. 4,470,251 issued to Bettcher, discloses a composite yarn having a core formed of two or three strands of metal wire combined with one strand of non-stretchable synthetic fiber run parallel to the wire. The core is then wrapped with at least two strands of synthetic fibers extending in opposite directions around the core.

U.S. Pat. No. 4,777,789 issued to Kolmes, et al., discloses a composite yarn having a core of synthetic fiber combined with a wire strand. The core is then wrapped with additional wire strands in opposite directions, and a cover wrapping applied to the composite. The wire strands are relatively heavy and stiff, ranging from 0.003 inch to 0.006 inch in diameter, and can also break and stick the wearer.

Japanese Patent 183,544 discloses a composite yarn with several cores aligned parallel to each other. The cores are formed of wires wrapped with synthetic fibers, and an additional fiber wrapped around the cores to form a cover for the yarn.

Although claiming comfort, flexibility, tactility, and good cut-resistance, the prior art yarn constructions described above fall short of achieving all the properties desired in protective apparel. While this apparel may provide effective cut, abrasion, and/or puncture protection, it is often relatively bulky and stiff thereby limiting effective use of the hands. In cold environments, such as meat processing plants, workers are required to grip and manipulate knives and other cutting implements during the day for several hours at a time. Even with multiple gloves on each hand, the hands quickly become stiff and sore. This problem is exacerbated by poor blood flow and circulation due to the cold temperature.

The present invention addresses these and other problems of the prior art by incorporating into a protective glove a unique fiber developed by Holofiber, Inc. of Beverly Hills, Calif., and marketed under the name HOLOFIBER®. The HOLOFIBER® relaxes the capillaries in the hand increasing blood flow where needed, thereby allowing the body to use its own energy to stay warm. HOLOFIBER® has other effects on the body and has been tested and shown to help increase strength, flexibility, comfort and promotes a more rapid recovery from injury or exertion.

SUMMARY OF THE INVENTION

Therefore, it is an object of the invention to provide a protective body-reactive composite yarn for use in body protective apparel.

It is another object of the invention to provide an article of apparel resistant to cuts, abrasions, and punctures.

It is another object of the invention to provide a protective body-reactive yarn which is particularly adapted for use in protective gloves worn by workers who use cutting implements, or who are exposed to sharp metal edges.

It is another object of the invention to provide a protective glove which is relatively light, thin, and comfortable.

It is another object of the invention to provide a protective glove which eliminates the need for a separate thermal liner.

It is another object of the invention to provide a protective glove which promotes enhanced muscle/grip strength.

It is another object of the invention to provide a protective glove which promotes increased blood flow in the hands.

It is another object of the invention to provide a protective glove which reduces the incidence of repetitive motion injury.

It is another object of the invention to provide a protective glove which increases the percentage of transcutaneous oxygen in the hands.

It is another object of the invention to provide a protective glove which effects improved skin oxygenation.

It is another object of the invention to provide a protective glove which reduces the incidence of carpel tunnel syndrom.

It is another object of the invention to provide a protective glove which is durability.

It is another object of the invention to provide a protective glove which is washable.

It is another object of the invention to provide a protective glove which is resistant to chemicals.

It is another object of the invention to provide a protective glove incorporating a composite yarn which can be dyed different colors like any ordinary textile without a change in durability, washability, or resistance to chemicals.

It is another object of the invention to provide a protective glove incorporating a composite yarn which has a similar feel and texture as does high quality cotton textiles.

It is another object of the invention to provide a protective glove incorporating a composite yarn which operates to shift the wavelength of incident light, by both shortening and lengthening the wavelength of the incident light that is exposed to the yarn.

It is another object of the invention to provide a protective glove incorporating a composite yarn which is extruded from a homogenized composition.

It is another object of the invention to provide a protective glove incorporating a composite yarn which contains an energized ceramic substance that stimulates the molecular structure of the body.

It is another object of the invention to provide a body-reactive composite yarn which incorporates thermal insulating fibers in a core of the yarn.

It is another object of the invention to provide a body-reactive composite yarn which incorporates thermal insulating fibers in a cover of the yarn.

It is another object of the invention to provide a body-reactive composite yarn which incorporates phase change materials in a core of the yarn.

It is another object of the invention to provide a body-reactive composite yarn which incorporates phase change materials in a cover of the yarn.

These and other objects of the present invention are achieved in the preferred embodiments disclosed below by providing a composite protective yarn for being incorporated into an article of apparel. The protective yarn has a core unit including a protective material selected from a group consisting of metallic filament, glass, and high tenacity fiber having a tensile strength of at least 7 grams per denier. A cover is applied to the core unit and is adapted for residing adjacent the skin. The cover includes an optically responsive material adapted for absorbing infrared radiation emitted from the human body at a first wavelength and returning the absorbed radiation to the body at a second longer wavelength. This relaxes capillaries and promotes increased blood flow to body parts covered by the article of apparel.

The term "core unit" refers to any fiber, metallic, or glass structure located within the outermost yarn cover. The term "cover" refers to any structure surrounding or encasing the core unit, either partially or entirely.

According to another preferred embodiment of the invention, the cover is formed of a powder and carrier material. The powder includes elements selected from a group consisting of silicones, carbons, and vitreous glasses.

According to another preferred embodiment of the invention, the vitreous glasses are selected from a group consisting of oxides of aluminum, titanium, silicone, boron, calcium, sodium, and lithium.

Preferably, the carrier material is a polymer resin.

According to another preferred embodiment of the invention, the resin is selected from a group consisting of rayon, polyester, nylon, acrylic, polyamide, and polyimide.

According to another preferred embodiment of the invention, the cover is formed of a powder and polymer resin composition extruded to form a spun or continuous filament cover strand adapted for wrapping around and encasing the core unit.

According to another preferred embodiment of the invention, the metallic filament of the core unit is a flexible stainless steel filament having a diameter in a range of between 6 microns and 50 microns.

According to another preferred embodiment of the invention, the core unit further includes a fiber selected from a group consisting of polyethylene, polyester, copolyesters, aramid, liquid crystal polymer fibers, polyamides, PVA-based fibers, polysulfide fibers, and synthetically produced silk fibers.

According to another preferred embodiment of the invention, the core unit further includes a fiber selected from a group consisting of natural organic and inorganic fibers.

According to another preferred embodiment of the invention, the cover further includes a multi-filament fiber strand selected from a fiber group consisting of polyethylene, polyester, copolyesters, aramid, liquid crystal polymer fibers, polyamides, PVA-based fibers, polysulfide fibers, and synthetically produced silk fibers.

According to another preferred embodiment of the invention, the cover further includes a multi-filament fiber strand selected from a fiber group consisting of natural organic and inorganic fibers.

In another embodiment, the invention is an article of apparel including a protective, flexible yarn. The yarn has a core unit including a protective material selected from a group consisting of metallic filament, glass, and high tenacity fiber having a tensile strength of at least 7 grams per denier. A cover is applied to the core unit and is adapted for residing adjacent the skin. The cover is formed of an optically responsive material adapted for absorbing infrared radiation emitted from the human body at a first wavelength and returning the absorbed radiation to the body at a second longer wavelength. This relaxes capillaries and promotes increased blood flow to body parts covered by the article of apparel.

According to another preferred embodiment of the invention, the article of apparel is a protective glove.

In yet another embodiment, the invention is a multi-component protective fabric adapted for incorporating into an article of apparel. The fabric includes an inner fabric layer comprising a yarn adapted for residing primarily adjacent the skin. The yarn includes an optically responsive material adapted for absorbing infrared radiation emitted from the human body at a first wavelength and returning the absorbed radiation to the body at a second longer wavelength. This relaxes capillaries and promotes increased blood flow to body parts covered by the article of apparel. An outer fabric layer comprises a yarn including a protective material selected from a group consisting of metallic, glass, and high tenacity fiber having a tensile strength of at least 7 grams per denier. The inner and outer fabric layers are formed concurrently by knitting a plaited construction.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
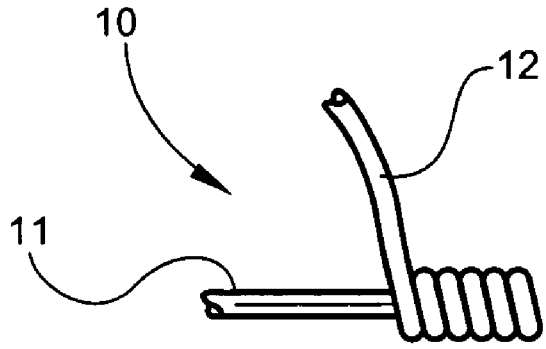
FIG. 1 is an enlarged fragmentary view of a protective yarn according to one preferred embodiment of the present invention.
Figure 2:
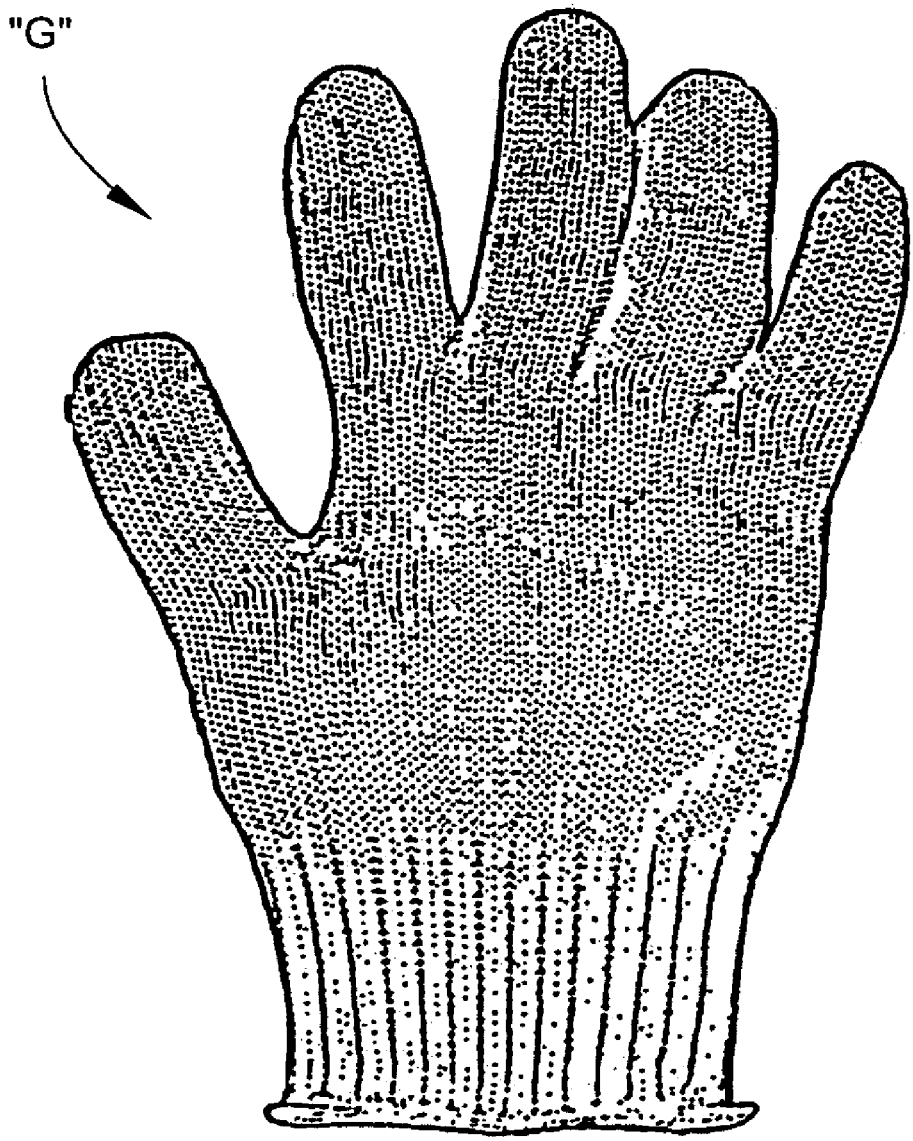
FIG. 2 is a cut-resistant glove incorporating a protective composite yarn according to the present invention.

Referring now specifically to the drawings, a composite protective yarn according to the present invention is illustrated in FIG. 1 and shown generally at reference numeral 10. The protective yarn 10 is incorporated in various types of cut, abrasion, and puncture-resistant apparel used in industries such as meat processing, construction, landscaping, floral, medical, and farming. In one application, the yarn 10 is run through standard glove knitting equipment to form a seamless cut-resistant glove "G", as shown in FIG. 2. In addition, standard V-bed, flatbed, or circular-knitting equipment can be used to make protective sleeves, leggings or aprons, using standard knitting techniques well known in the art. In other applications, the composite yarn 10 may be incorporated in woven layers, non-woven layers, or three-dimensionally knit or woven structures.

Examples of various protective articles and methods of constructing protective apparel are described in U.S. Pat. No. 6,155,084 owned by World Fibers, Inc. of Concord, N.C. The complete disclosure of this patent is incorporated herein by reference.

As described further below, the composite yarn 10 of the present invention includes a longitudinal core unit 11 and a spiral-wrapped cover 12. The core unit 11 is formed of a cut-resistant material, such as metallic filament, glass, and high tenacity fiber. The yarn cover 12 is constructed of body-reactive fibers which operate to absorb infrared (IR) radiation emitted from the body. This radiation excites electrons in the fibers. As the electrons return to their normal state, they re-emit infrared radiation at a longer wavelength. This longer IR energy is able to penetrate body tissues where it is absorbed causing the capillaries to relax and become less restricted resulting in greater blood flow. In cold temperatures, capillaries constrict to help conserve body heat, the present yarn 10 relaxes the capillaries increasing blood flow where needed, thereby allowing the body to use its own energy to stay warm. The yarn 10 has other effects on the body, such as providing increased strength, flexibility, and comfort and promoting a more rapid recovery from injury or exertion. Further details of the core unit 11 and cover 12 are provided below.

Core Unit 11

According to one embodiment, the core unit 11 of the present composite yarn 10 comprises a core yarn constructed of synthetic, high tenacity, multi-filament fiber strands bound together by a flexible metallic filament. The core yarn is preferably a liquid crystal polymer yarn having a denier ranging from between 40 and 1,000 with 600 denier being most preferable. Alternatively, the core yarn may include olefin fibers, such as high or ultra high molecular weight polyethylene, polyester and high tenacity polyesters and copolyesters, polyamides, PVA-based fibers, polysulfide-based fibers, natural fibers, and synthetically produced silk fiber strands. The core yarn may comprise other high tenacity fibers, such as aramid, poly {p-phenylene-2,6-benzobisoxazole} (PBO), and poly {diimidazo pyridinylene (dihydroxy) phenylene} (M5). Each of these fibers has a tensile strength of at least 7 grams per denier. Suitable commercial fibers include: VECTRAN® liquid crystal polymer fibers, TWARON® micro-denier fiber, SPECTRA SHIELD® PCR fiber, DYNEEMA® UD (unidirectional) fiber, PBO ZYLON® fiber, and aramid KEVLAR® fiber. The core unit may further comprise Holofiber®, as described above, S-2 glass fiber, carbon fiber, silicone-carbide, and graphite, or thermal insulating fibers such as wool.

The metallic filament is preferably a fully annealed stainless steel. The diameter of the filament ranges from between 6 microns and 50 microns. The core unit 11 may have multiple metallic filaments which are spiral wrapped around the core yarn. For example, the core unit may contain between 2 and 250 metallic filaments with about 91 filaments being the most preferred in this embodiment. The size of each metallic filament ranges from between 6 microns and 50 microns with about 12 microns being the most preferred size. The core unit 11 may include only one or multiple, longitudinally bundled core yarns identical to that described above. In addition, the protective yarn 10 may include multiple longitudinally bundled core units 11, such as described in applicant's prior issued U.S. Pat. No. 5,806,295 entitled "Protective Apparel, Multiple Core Cut-Resistant Yarn, and Method of Constructing a Multiple Core Cut-Resistant Yarn". The complete disclosure of this patent is incorporated herein by reference.

Yarn Cover 12

The body-reactive yarn cover 12 mentioned above is formed of an optically responsive and biologically benign composition extruded into a continuous filament strand or staple fiber, such as that known commercially as HOLOFIBER®. This composition is described in the published international PCT patent application number WO 03/083189 A1 filed on Mar. 24, 2003 by Schnurer et al. and entitled "Polymer Fiber Composition and Method". The complete disclosure of this application is incorporated herein by reference. The fiber strand cover 12 is helically wrapped around the longitudinal core unit 11 in a conventional manner at a rate of between 8–12 turns per inch.

According to one embodiment, the fiber strand forming the cover 12 is extruded from a composition comprising a fine mineral powder dispersed within a carrier material, such as polyester (PET) resin. The active materials forming the powder are selected based upon several characteristics. One characteristic is that the active materials, in particle form, are biologically benign, or inert. The materials preferably exhibit one of two optical properties: being transparent or having a different refractive index than the carrier material. Specific active materials applicable for use in the present composition include silicon, boron, calcium, sodium, and lithium.

In a specific embodiment, the powder comprises titanium dioxide ($TiO_2$—in rutile form), quartz ($SiO_2$), and aluminum oxide ($Al_2O_3$). Preferably, the titanium dioxide, quartz, and aluminum oxide are in granular form, and comprise about 1 to 2 percent of the total weight of the composition. The titanium dioxide grains are substantially triangular with an average grain size of about 2.0 microns or less. The aluminum oxide grains are scalloped-shaped, and have an average grain size of about 1.4 microns or less. The quartz grains are rounded in shape, and have an average grain size of about 1.5 microns or less.

The polymer PET resin of the composition is initially in pellet form and dried to remove moisture. Once dried, the powder is dispersed into the resin and the composition mixed and heated. The resulting liquid is extruded into fiber that is drawn into continuous filament strands or staple fibers of various lengths. This process of grinding, combining, and extrusion is well known in the art, as described in, for example, U.S. Pat. Nos. 6,204,317; 6,214,264; and 6,218,007. Complete disclosures of these patents are incorporated herein by reference. To produce one half ton of fiber, about 100 pounds of the powder is combined with about 1000 pounds of PET resin. In an alternative embodiment, the powder may be introduced into the resin by other processes known in the art, such as compounding. In this embodiment, 100 pounds of the powder may be combined with about 250 to about 300 pounds of PET resin.

The basic techniques for forming polyester fiber by extrusion from commercially available raw materials are well known to those of ordinary skill in this industry. These conventional techniques are quite suitable for forming the fiber strand cover 12 of the present composite yarn 10. An example of fiber extrusion is described in U.S. Pat. No. 6,067,785, which is incorporated herein by reference.

Figure 3:
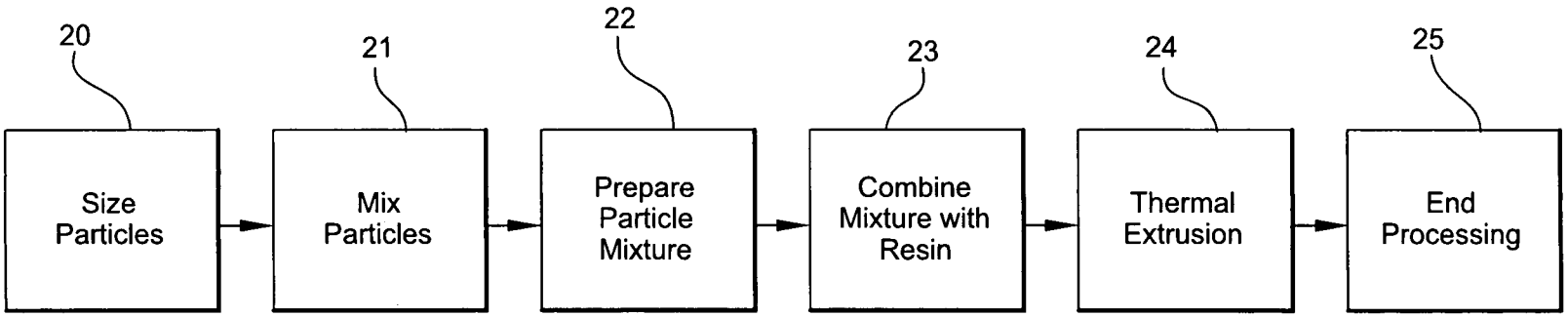
FIG. 3 is a flow diagram illustrating the extrusion process for forming the cover strand of the present composite yarn.

A simple flow chart shown in FIG. 3 illustrates the process of creating the resin filaments from which the fibrous yarn cover 12 is made. In step 20, the sizes of one or more types of the particles are adjusted by pre-processing if the particles are not within the desired range of particles sizes. In step 21, the particles are physically combined by mechanical mixing to provide a powder or other particle mixture. In step 22, the particle mixture is prepared by compounding or fluid suspension or other known mechanisms to permit introduction into the filament forming process of step 23. Conventional compounding techniques include forming a high concentration of the particle in pellets, typically on the order of ⅛ inch diameter rods about 1" long. In the filament forming process step 23, these pellets are combined with additional pellets or chips of resin in order to achieve the desired loading or concentration of particle in the final filament. Conventional fluid suspension techniques include suspending the particles in a liquid, such a propylene glycol, which is compatible with the resin used in filament forming step 23. The filament forming process in step 24 is conventional thermal extrusion. Thereafter, depending upon the final use of the filaments, end process steps 25 may be applied.

Figure 4:
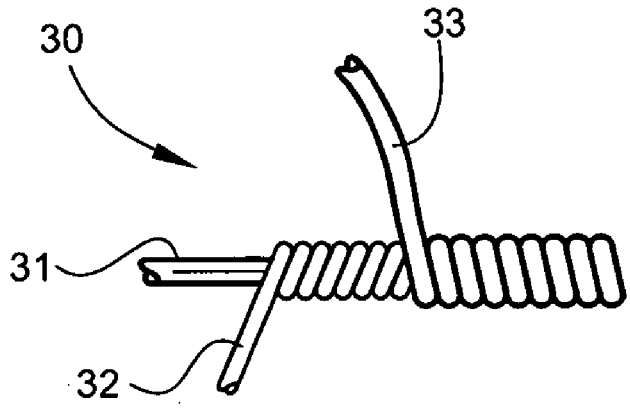
FIG. 4 is an enlarged fragmentary view of a protective yarn according to a second preferred embodiment of the present invention.

In a further embodiment shown in FIG. 4, the protective composite yarn 30 includes a core unit 31, as previously described, and inner and outer cover strands 32 and 33. The inner cover strand 32 comprises a high tenacity, abrasion-resistant, spun or continuous multi-filament yarn, such as 630 denier, high or ultra high molecular weight polyethylene. The inner strand 32 is spiral wrapped around the core unit 31 at a rate of between 8–12 turns per inch. After application of the interior cover strand 32, the core unit 31 is further spiral wrapped in an opposite direction by an exterior cover strand 33 identical to the body-reactive cover 12 described above. The cover strand 33 is also wrapped at a rate of between 8–12 turns per inch. The inner and outer cover stands 32, 33 may further include a Holofiber® blend incorporating wool and other thermal insulating fibers.

The resulting composite yarn 10, 30 in each of the embodiments described above is incorporated into protective apparel adapted for wear directly against the skin. In the case of a protective glove "G", such as shown in FIG. 2, the outer yarn cover 12, 33 operates to absorb infrared (IR) radiation emitted by the hand. This radiation excites electrons in the outside cover yarn. As the electrons return to their normal state, they re-emit infrared radiation at a longer wavelength. This longer IR energy is able to penetrate cutaneous tissues in the hand were it is absorbed causing the capillaries to relax, and resulting in greater blood flow. The protective glove "G" is especially suited for use in cold temperatures, and by workers required to grip and manipulate tools, cutting implements, and other objects throughout the day. Under such conditions, capillaries in the hand constrict to help conserve body heat while blood flow and circulation decreases resulting in joint pain and stiffness. As a further result of this activity, many workers develop carpel tunnel syndrom and other repetitive motion injuries. Protective gloves "G" incorporating the present composite yarn offer substantial cut-resistance, while using the body's own energy to keep the hand warm and promote blood circulation.

In still further applications, extruded fiber strands of the powder/resin composition described above ("body-reactive fiber") may be plaited with two or more fabric layers. The plaited nature of the first and second fabric layers forms an integral, bi-component, composite fabric with the first layer made of a yarn comprising the present body-reactive fibers residing primarily on the skin side surface of the fabric and the yarn of the second layer residing primarily on the surface opposite the skin side surface. Although each fabric layer of the composite fabric is distinct and separate, each is integrated with the other in a double knit plaited construction. As a result, the composite fabric functions as a single unit.

In one example of the present fabric, the skin side surface may include 70%–90% by weight of a first yarn incorporating the body-reactive fibers and 10%–30% by weight of a second yarn incorporating a cut-resistant element, while the surface opposite the skin side surface may be 70%–90% by weight of the second cut-resistant yarn and 10%–30% weight of the first body-reactive yarn. The cut-resistant element of the second yarn preferably includes metallic or glass strands, or high-tenacity fibers. The second yarn may also comprise wool or other insulating spun or continuous filament fibers, such as that known commercially as Thinsulate™ by 3M and Thermax® by DuPont.

An example of a double-knit plaited fabric is described in U.S. Pat. No. 5,547,733 issued to Maiden Mills Industry, Inc. of Lawrence, Mass. The complete disclosure of this patent is incorporated herein by reference.

A body-reactive protective yarn, protective apparel, and composite fabric are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A composite protective yarn for being incorporated into an article of apparel, said protective yarn comprising:

(a) a core unit comprising a protective material selected from a group consisting of metallic, glass, and high tenacity fiber having a tensile strength of at least 7 grams per denier; and (b) a cover applied to said core unit and adapted for residing adjacent the skin, said cover comprising an optically responsive material adapted for absorbing infrared radiation emitted from the human body at a first wavelength and returning the absorbed radiation to the body at a second longer wavelength, thereby relaxing capillaries and promoting increased blood flow to body parts covered by the article of apparel.

2. A protective yarn according to claim 1, wherein said cover comprises a powder and carrier material, said powder including elements selected from a group consisting of silicones, carbons, and vitreous glasses.

3. A protective yarn according to claim 2, said vitreous glasses are selected from a group consisting of oxides of aluminum, titanium, silicone, boron, calcium, sodium, and lithium.

4. A protective yarn according to claim 2, said carrier material comprises a polymer resin.

5. A protective yarn according to claim 4, wherein said resin is selected from a group consisting of rayon, polyester, nylon, acrylic, polyamide, and polyimide.

6. A protective yarn according to claim 1, wherein said cover comprises a powder and polymer resin composition extruded to form a continuous filament cover strand adapted for wrapping around and encasing said core unit, said powder including elements selected from a group consisting of silicones, carbons, and vitreous glasses.

7. A protective yarn according to claim 1, wherein the metallic filament of said core unit comprises a flexible stainless steel strand having a diameter in a range of between 6 microns and 120 microns.

8. A protective yarn according to claim 1, wherein said core unit further comprises a fiber selected from a group consisting of poly {p-phenylene-2,6-benzobisoxazole} (PBO), polyethylene, polyester, copolyesters, aramid, liquid crystal polymer fibers, polyamides, PVA-based fibers, polysulfide fibers, and synthetically produced silk fibers.

9. A protective yarn according to claim 1, wherein said core unit further comprises a fiber selected from a group consisting of natural organic and inorganic fibers.

10. A protective yarn according to claim 1, wherein said cover further comprises a multi-filament fiber strand selected from a fiber group consisting of poly {p-phenylene-2,6-benzobisoxazole} (PBO), polyethylene, polyester, copolyesters, aramid, liquid crystal polymer fibers, polyamides, PVA-based fibers, polysulfide fibers, and synthetically produced silk fibers.

11. A protective yarn according to claim 1, wherein said cover further comprises a multi-filament fiber strand selected from a fiber group consisting of natural organic and inorganic fibers.

12. A protective yarn for being incorporated into an article of apparel, said protective yarn comprising:

(a) a core unit comprising a protective material selected from a group consisting of metallic filament, glass, and high tenacity fiber having a tensile strength of at least 7 grams per denier; and (b) a cover applied to said core unit and adapted for residing adjacent the skin, said cover comprising an optically responsive material adapted for absorbing infrared radiation emitted from the human body at a first wavelength and returning the absorbed radiation to the body at a second longer wavelength, thereby relaxing capillaries and promoting increased blood flow to body parts covered by the article of apparel, and said optically responsive material comprising a resin composition extruded to form a continuous filament cover strand adapted for wrapping around and encasing said core unit.

13. An article of apparel including a protective, flexible yarn comprising:

(a) a core unit comprising a protective material selected from a group consisting of metallic filament, glass, and high tenacity fiber having a tensile strength of at least 7 grams per denier; and (b) a cover applied to said core unit and adapted for residing adjacent the skin, said cover comprising an optically responsive material adapted for absorbing infrared radiation emitted from the human body at a first wavelength and returning the absorbed radiation to the body at a second longer wavelength, thereby relaxing capillaries and promoting increased blood flow to body parts covered by the article of apparel.

14. An article of apparel according to claim 13, wherein said cover comprises a powder and carrier material, said powder including elements selected from a group consisting of silicones, carbons, and vitreous glasses.

15. An article of apparel according to claim 14, said vitreous glasses are selected from a group consisting of oxides of aluminum, titanium, silicone, boron, calcium, sodium, and lithium.

16. An article of apparel according to claim 14, said carrier material comprises a polymer resin.

17. An article of apparel according to claim 16, wherein said resin is selected from a group consisting of rayon, polyester, nylon, acrylic, polyamide, and polyimide.

18. An article of apparel according to claim 13, wherein said cover comprises a powder and polymer resin composition extruded to form a continuous filament cover strand adapted for wrapping around and encasing said core unit, said powder including elements selected from a group consisting of silicones, carbons, and vitreous glasses.

19. An article of apparel according to claim 13, wherein the metallic filament of said core unit comprises a flexible stainless steel filament having a diameter in a range of between 6 microns and 125 microns.

20. An article of apparel according to claim 13, wherein said article comprises a protective glove.

21. A multi-component protective fabric adapted for incorporating into an article of apparel, said fabric comprising:

(a) an inner fabric layer comprising a yarn adapted for residing primarily adjacent the skin, said yarn including an optically responsive material adapted for absorbing infrared radiation emitted from the human body at a first wavelength and returning the absorbed radiation to the body at a second longer wavelength, thereby relaxing capillaries and promoting increased blood flow to body parts covered by the article of apparel;

(b) an outer fabric layer comprising a yarn including a protective material selected from a group consisting of metallic, glass, and high tenacity fiber having a tensile strength of at least 7 grams per denier; and (c) wherein said inner and outer fabric layers are formed concurrently by knitting a plaited construction.

22. A protective fabric according to claim 21, wherein the yarn of said inner fabric layer comprises a powder and carrier material, said powder including elements selected from a group consisting of silicones, carbons, and vitreous glasses.

23. A protective fabric according to claim 21, wherein the yarn of said outer fabric layer comprises a fiber selected from a group consisting of poly {p-phenylene-2,6-benzobisoxazole} (PBO), polyethylene, polyester, copolyesters, aramid, liquid crystal polymer fibers, polyamides, PVA-based fibers, polysulfide fibers, and synthetically produced silk fibers.

* * * * *